US011387059B2

(12) United States Patent
Wolfe

(10) Patent No.: US 11,387,059 B2
(45) Date of Patent: Jul. 12, 2022

(54) HIGH VOLTAGE VERTICAL BREAK DISCONNECT SWITCH WITH PLANETARY GEAR REDUCTION SWITCH DRIVE MECHANISM

(71) Applicant: CLEAVELAND/PRICE INC., Trafford, PA (US)

(72) Inventor: Daniel J. Wolfe, Trafford, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 0 days.

(21) Appl. No.: 17/374,111

(22) Filed: Jul. 13, 2021

(65) Prior Publication Data

US 2022/0157543 A1 May 19, 2022

Related U.S. Application Data

(60) Provisional application No. 63/114,167, filed on Nov. 16, 2020.

(51) Int. Cl.
*H01H 31/02* (2006.01)

(52) U.S. Cl.
CPC ..... *H01H 31/026* (2013.01)

(58) Field of Classification Search
CPC ..... H01H 31/026; H01H 27/10; H01H 31/28; H01H 33/02; F16H 3/72; B60K 17/35
USPC ..... 200/48 V, 48 R, 271, 253.1; 429/405; 475/1, 11, 220, 329
See application file for complete search history.

(56) References Cited

U.S. PATENT DOCUMENTS

| | | | | |
|---|---|---|---|---|
| 2,521,484 | A | 9/1950 | Schmidt | |
| 9,355,797 | B1 * | 5/2016 | Cleaveland | H01H 33/6661 |
| 2009/0197730 | A1 * | 8/2009 | Berhan | B60W 20/00 475/150 |

OTHER PUBLICATIONS

Cleaveland/Price Inc. Bulletin DB-06DP-A20, entitled "V2-CA Aluminum Vertical Break Switch 500kV-3000 A.", four (4) pages.

* cited by examiner

*Primary Examiner* — Edwin A. Leon
*Assistant Examiner* — Iman Malakooti
(74) *Attorney, Agent, or Firm* — Ronald S. Lombard

(57) ABSTRACT

A high voltage vertical break disconnect switch with a planetary gear reduction drive assembly including at least one stage operatively attached to a perpendicular rotatable insulator of the high voltage vertical break disconnect switch. The planetary gear reduction drive assembly includes a lower crankshaft part and a cooperating upper crankshaft part. The lower crankshaft part is solidly connected to the perpendicular rotatable insulator. The planetary gear reduction drive assembly includes an output that drives the upper crankshaft part. The upper crankshaft part drives a movable link assembly that causes a switch blade of the vertical break switch to open and close.

20 Claims, 6 Drawing Sheets

HIGH VOLTAGE VERTICAL BREAK DISCONNECT SWITCH WITH PLANETARY GEAR REDUCTION SWITCH DRIVE MECHANISM

CROSS-REFERENCE TO RELATED APPLICATION

This application claims the benefit of U.S. Provisional Patent Application No. 63/114,167 filed Nov. 16, 2020, which is incorporated herein by reference in its entirety.

BACKGROUND OF THE INVENTION

The invention relates generally to a vertical break disconnect switch for high voltage applications and, more particularly, to an extra high voltage (EHV) vertical break disconnect switch.

In electric power systems, high voltage disconnect switches are employed to isolate transmission lines and high voltage electrical apparatus to permit the inspection or repair of such apparatus or redirect power or other reasons. A common outdoor vertical break disconnect switch drive mechanism includes a post insulator connected to a current carrying blade through a space linkage. Typically, when the switch is opening the insulator is caused to rotate through 100 degrees about its longitudinal axis while the switch blade rotates about its longitudinal axis and then the switch blade is caused to move about a hinge mounted at a proximal end of the blade causing the blade to pivot about its proximal end through about 90 degrees in the vertical direction and thereby provide an air gap across the open switch. The rotating post insulator is solidly connected to an above-mounted single-piece crank shaft. The crank shaft drives a link connecting to the switch blade assembly. High voltage vertical break disconnect switches such as, extra high voltage (EHV) air insulated disconnect switches have comparatively long blades which become heavy under thick ice condition greatly increasing the required power output from the switch's operator putting extra stress on the rotating post insulator. EHV switches are typically rated for handling voltages from 345 kV to 800 kV.

Such high voltage vertical break disconnect switches, including horizontally or vertically mounted high voltage vertical break switches, are characterized by the elongated switch blade when closing, to first swing about a stationary pivot at the proximal end of the blade, in a first switch closing operation and subsequently to rotate about its own axis in a second switch closing operation. A reverse operation of the switch takes place during opening. As such, a horizontally mounted vertical break disconnect switch blade when closing in the first switch closing operation first swings about the stationary pivot from a vertical orientation to a horizontal orientation, where an elongated blade contact portion or tip carried at the distal end of the switch blade comes into first contact with a break jaw stop of a break jaw assembly at an intermediate closing position of the switch. The switch blade then, in the second switch closing operation, rotates about its own longitudinal axis between the parting contact jaws, with the blade tip's side edges forcing the parting contact jaws to spread until desirably full contact with the oppositely disposed break jaws is accomplished in the final closing of the switch. The side edges of the blade contact portion or tip at full contact are typically about horizontal when in full contact with the contact fingers of the break jaws. A basic patent for such a high voltage vertical break switch is disclosed in U.S. Pat. No. 2,521,484, entitled "Electric Switch Whose Blade Swings and Twists", by Frederick G. Schmidt, issued Sep. 5, 1950. Such a vertical break switch for very high voltage applications is disclosed in Cleaveland/Price Inc. Bulletin DB-06DP-A20, entitled "V2-CA Aluminum Vertical Break Disconnect Switch 500 kV-3000 A, which is incorporated herein by reference as though fully set forth. Cleaveland/Price Inc. is the assignee of the present invention.

Such a standard prior art vertical break disconnect switch includes linkage connecting the switch blade driven by a prime mover, such as, an electric motor or geared hand crank assembly rotating a perpendicular cylindrically-shaped insulator that is directly connected to a crank shaft mounted above the rotating insulator. An adjacent non-rotating perpendicular cylindrically-shaped insulator supports a live base assembly that includes the driven linkage connecting to the switch blade which is actuated by the rotating insulator.

It is therefore an object of the present invention to provide a high voltage vertical break disconnect switch such as, an extra high voltage (EHV) vertical break disconnect switch with a compact and economical drive mechanism that places reduced stress on the rotating perpendicular cylindrically-shaped insulator and power transmitting components between the prime mover and the switch crank component compared to prior art switches, particularly when under heavy thick ice conditions when opening or closing.

SUMMARY OF THE INVENTION

The object is achieved by the high voltage vertical break disconnect switch of the present invention having an improved drive mechanism for reducing the loads transmitted by the switch's drive components between the switch's operator, i.e., a prime mover such as a motor or geared hand crank assembly, and the switch's crank shaft mounted on top of the perpendicular rotating cylindrically-shaped insulator. This is accomplished by the introduction of a planetary gear reduction assembly into a modified crank shaft of the switch which requires replacing the prior art existing single piece crank shaft with a two-piece crank shaft. The planetary gear reduction assembly of the present invention includes a planetary gear reduction switch drive mechanism having at least one stage. In the case of a high voltage vertical break disconnect switch of the extra high voltage (EHV) type rated for voltages of greater than 500 kV, a two-stage planetary gear reduction switch drive mechanism of the present invention is preferred. In the case of a high voltage vertical break disconnect switch rated for voltages of 345 kV and lower, a single-stage planetary gear reduction switch drive mechanism of the present invention may be utilized. The linkage beyond the crank shaft that moves the blade between the open and closed positions is the same as the prior art standard arrangement for a standard prior art high voltage vertical break disconnect switch.

In the case of a high voltage vertical break disconnect switch of the extra high voltage (EHV) type, a two-stage planetary gear reduction switch drive mechanism is installed between the top of the rotating perpendicular cylindrically-shaped insulator to virtually surround in cooperating relationship the two-piece crank shaft, which is operatively attached to the rotating insulator. The two-stage planetary gear reduction switch drive mechanism is mounted in a live base assembly. The two-piece crank shaft has a lower shaft part and an upper shaft part. The lower shaft part of the two-piece crank shaft is solidly connected to the top of the rotating perpendicular cylindrically-shaped insulator, while the upper shaft part of the modified crank shaft is rotatable with respect to the lower shaft part by means of a secondary gear train of the two-stage planetary gear reduction. The top of the lower shaft part of the modified crank shaft operatively engages a sun gear connected as the input gear to a first stage planetary gear set. A first stage planet carrier assembly is rotated by means of the interaction of the input sun gear and a stationary first stage ring gear which is held from rotating by means of stationary insulator side plates of the live base assembly. A second stage sun gear is rigidly connected to the first stage planet carrier and is the input gear for the second stage. A second stage carrier is rotated by the interaction between the second stage sun gear and a second stage ring gear which is held stationary in the same manner as the first stage ring gear. The second stage planet carrier is solidly connected to the upper shaft part of the modified two-piece crank shaft which is the output of the gear train and used to drive the vertical break live base assembly linkage. The upper shaft part of the modified two-piece crank shaft accepts plates that creates a traditional crank component which is used to drive the vertical break linkage.

The standard prior art vertical break switch linkage is driven by the rotating perpendicular cylindrically-shaped insulator that is directly connected to the two-piece crank shaft of the present invention. The live base assembly is held stationary by a non-rotating perpendicular cylindrically-shaped insulator which supports the live base assembly that includes the live base assembly linkage which can be actuated by rotating the rotating insulator.

In the case of a high voltage vertical break disconnect switch rated for system voltages less than 345 kV, a single-stage planetary gear reduction switch drive mechanism is installed between the top of the rotating perpendicular cylindrically-shaped insulator to virtually surround in cooperating relationship the two-piece crank shaft, which is operatively attached to the rotating insulator. The single-stage planetary gear reduction switch drive mechanism is mounted in the live base assembly. The two-piece crank shaft as mentioned has a lower shaft part and an upper shaft part. The lower shaft part of the two-piece crank shaft is solidly connected to the top of the rotating perpendicular cylindrically-shaped insulator, while the upper shaft part of the modified crank shaft is rotatable with respect to the lower shaft part by means of a gear train of the single stage planetary gear reduction switch drive mechanism. The top of the lower shaft part of the modified crank shaft operatively engages a sun gear connected as the input gear to a single stage planetary gear set. A single stage planet carrier assembly is rotated by means of the interaction of the input sun gear and a stationary single stage ring gear which is held from rotating by means of stationary insulator side plates of the live base assembly. The single stage planet carrier is solidly connected to the upper shaft part of the modified two-piece crank shaft which is the output of the gear train and used to drive the vertical break live base assembly linkage. The upper shaft part of the modified two-piece crank shaft accepts plates that creates a traditional crank component which is used to drive the vertical break linkage.

These and other aspects of the present invention will be further understood from the entirety of the description, drawings and claims.

BRIEF DESCRIPTION OF THE DRAWINGS

For a better understanding of the invention reference may be made to the accompanying drawings exemplary of the invention, in which.

DETAILED DESCRIPTION OF THE INVENTION

Figure 1:
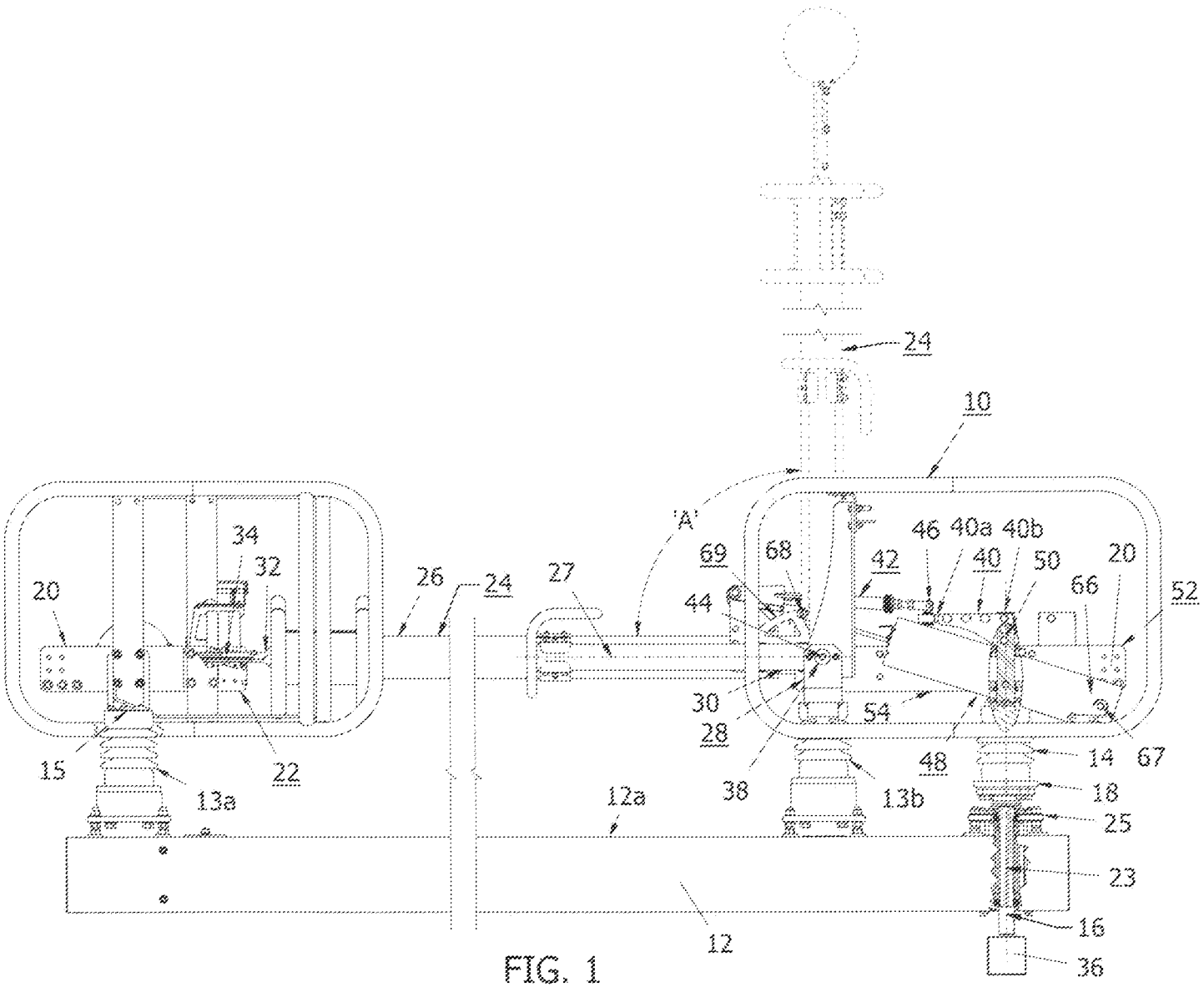
FIG. 1 is a schematic partially cut away side-elevation view of an extra high voltage vertical break switch of the prior art shown in both the closed position and open position.

With reference to FIG. 1 showing the prior art, a high voltage vertical air break disconnect switch 10 in the electrically closed position and also in the electrically opened position, indicated by the curved arrow and dashed lines, is shown. The switch 10 includes a longitudinal beam 12 having a top 12*a* with three perpendicularly mounted post-type cylindrically-shaped insulators 13*a*, 13*b* and 14. A first post insulator 13*a* and a second post insulator 13*b* are stationary and are mounted as shown in FIG. 1. The third post insulator 14 is rotatable and can be driven by a prime mover 36, such as an electric motor with controls or a manual geared hand crank assembly having a prime mover drive shaft 16, as well known in the art, operatively attached to the bottom 18 of the third post insulator 14.

A line-terminal connection 20 and a stationary break-jaw contact assembly 22 are attached to the top 15 of the stationary first post perpendicular cylindrically-shaped insulator 13*a*. The break-jaw contact assembly 22 may have U-shaped break-jaws, not shown in the drawings. An elongated movable switch-blade assembly 24 makes electrical contact with the stationary break-jaw contact assembly 22, when the switch 10 is closed. The elongated movable switch-blade assembly 24 includes an elongated switch blade 26 which is pivotally mounted at its proximal end 30 to a hinge assembly 28, for electrically opening and closing the high voltage vertical break disconnect switch 10. The general details of this arrangement are apparent by reference to FIG. 1. The elongated switch blade 26 may be tubular for example. A switch blade contact portion, is arranged at a distal end 32 of the switch blade 26, such as a relatively flat switch blade tip 34, for contacting the U-shaped stationary break-jaw contact assembly 22, when the switch 10 is in the electrically closed position, as shown in FIG. 1.

As shown in FIG. 1, the rotatable third post perpendicular cylindrically-shaped insulator 14 is capable of rotary operative motion about its longitudinal axis 23 for driving the switch-blade assembly 24 to mechanically interconnect the operation of the elongated movable switch-blade assembly 24 with the rotation of the rotatable third post insulator 14. As mentioned, the switch 10 includes a prime mover, such as an electric motor or geared hand crank assembly 36, shown in FIG. 1 schematically as a box, for three phase group operation, for rotating the prime mover drive shaft 16 to cause the rotation of the third post perpendicular cylindrically-shaped insulator 14 to open and close the switch 10, as is well known in the art. A drive shaft support bearing 25 is provided for supporting the prime mover drive shaft 16 and the rotatable third post insulator 14, as shown in FIG. 1.

The hinge assembly 28 is provided with a blade hinge pivot point, which may be hinge shaft 38; the hinge assembly 28 in electrically conductive relationship with the elongated switch blade 26. The switch-blade 26 is operatively attached at its proximal end 30 to the hinge shaft 38 which blade hinge pivot point is used for rotating the blade 26 to the open position as shown in FIG. 1. A crank assembly 40 at one end 40*a* operatively engages a movable link assembly 42 through pin 46, which is rotated by the operating motion of the rotatable third post perpendicular cylindrically-shaped insulator 14. The movable link assembly 42 is in operative arrangement with the hinge assembly 28 for rotating the elongated switch blade 26 from a closed electrically conductive position to an open electrically non-conductive position. The crank assembly 40 is connected at the other end 40*b* to a one piece crank shaft 50 supported by and substantially housed in a live base assembly 52, as shown in FIG. 1, which is the prior art. The live base assembly 52 is mounted on and supported by stationary first post perpendicular cylindrically-shaped insulator 13*b*, which as can be seen in FIG. 1, adjoins rotatable third post perpendicular cylindrically-shaped insulator 14. The live base assembly 52 includes a straight unbent first side plate 54 and an oppositely disposed straight unbent second side plate 56, not shown in FIG. 1. The crank assembly 40 is attached to the one piece crank shaft 50 as shown in FIG. 1. A spring counter balance tube assembly 48 is connected at one end 66 to a fixed pin 67 through the live base assembly 52 and at the other end 68 to spring counterbalance arm assembly 69. The spring counter balance tube assembly 48 acts to counter balance the weight of the switch-blade assembly 24.

Regarding the operation of the switch 10 during closing, the movement of the rotatable third post perpendicular cylindrically-shaped insulator 14 initially causes the one piece crank shaft 50 and the elongated movable switch-blade assembly 24 to rotate about the hinge axis 44, through a predetermined angle 'A'—from a vertical orientation to a horizontal orientation as shown in FIG. 1. During this movement, the switch 10 goes from the open electrically non-conductive position to an almost fully closed position, as indicated by the solid curved line with double arrows in FIG. 1, which is designated as angle 'A' of about 90°. This initial rotation results in the switch 10 being in a so-called intermediate closed position, not shown in the drawings, with the switch blade tip 34 entering the U-shaped stationary break-jaw contact assembly 22—but the tip is at a non-horizontal orientation between the jaw stationary contacts—and thus is not yet in the fully electrically closed position with the jaw stationary contacts, not shown. In the second switch closing operation, instead of the switch-blade assembly 24 rotating about the hinge axis 44, the switch-blade assembly 24 rotates about its own longitudinal axis 27 to the fully closed position as shown in FIG. 1.

Figure 2:
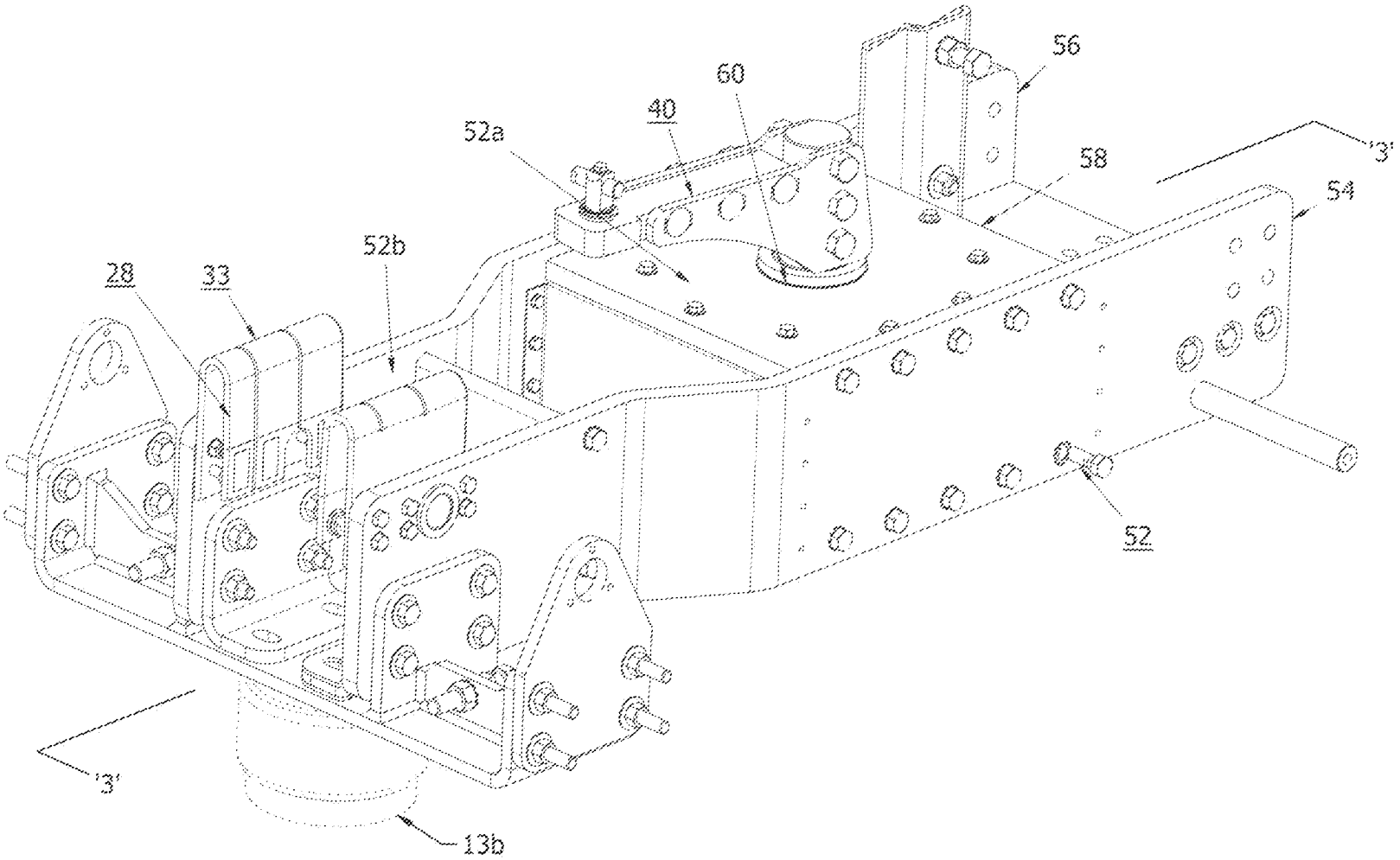
FIG. 2 is a schematic perspective view of the live base assembly in the configuration of the invention.
Figure 3:
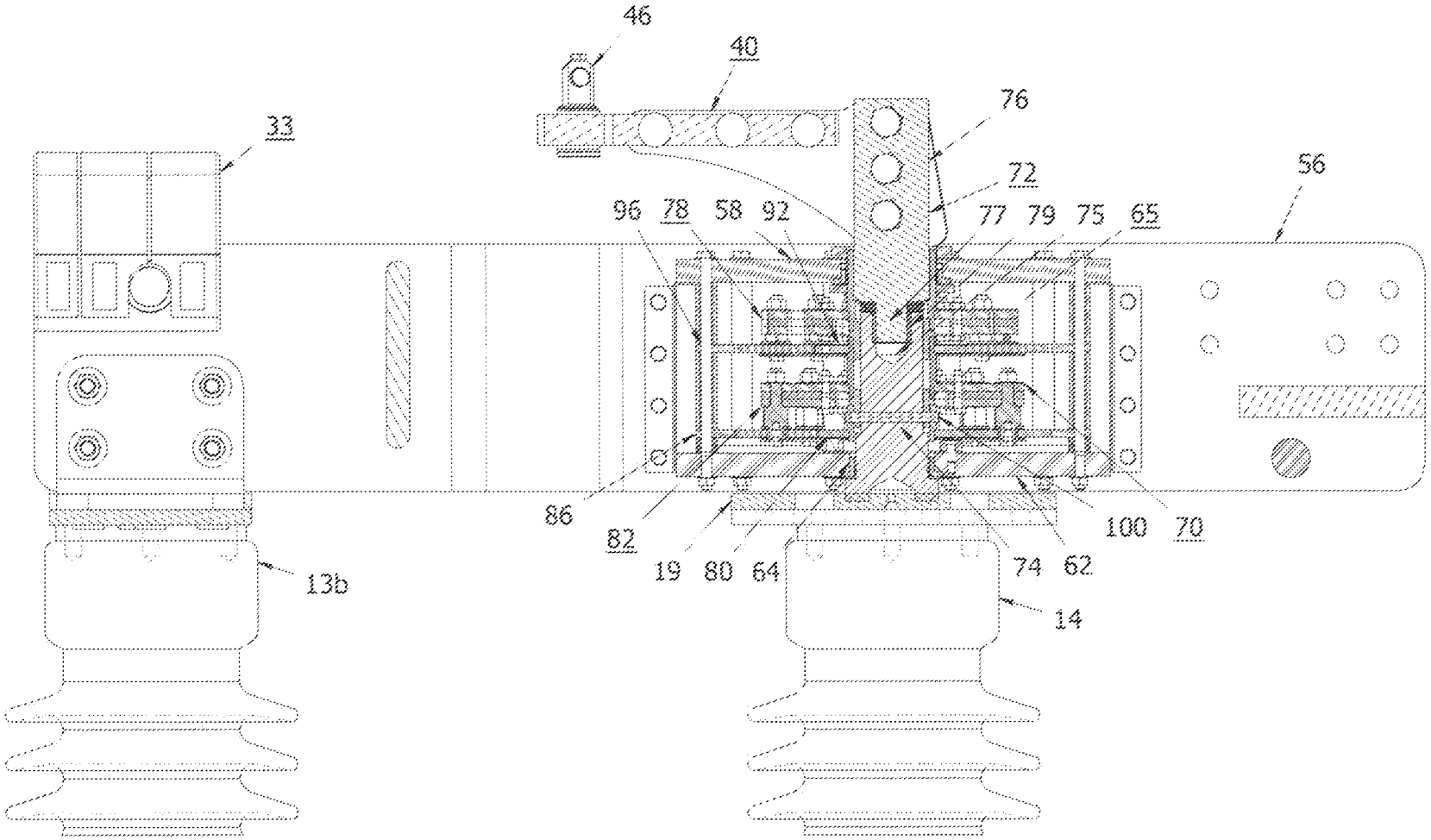
FIG. 3 is a schematic sectional elevation view of the live base assembly of the invention with a two-stage planetary gear reduction assembly mounted on the rotating perpendicular cylindrically-shaped insulator taken along the line '3'-'3' of FIG. 2.
Figure 4:
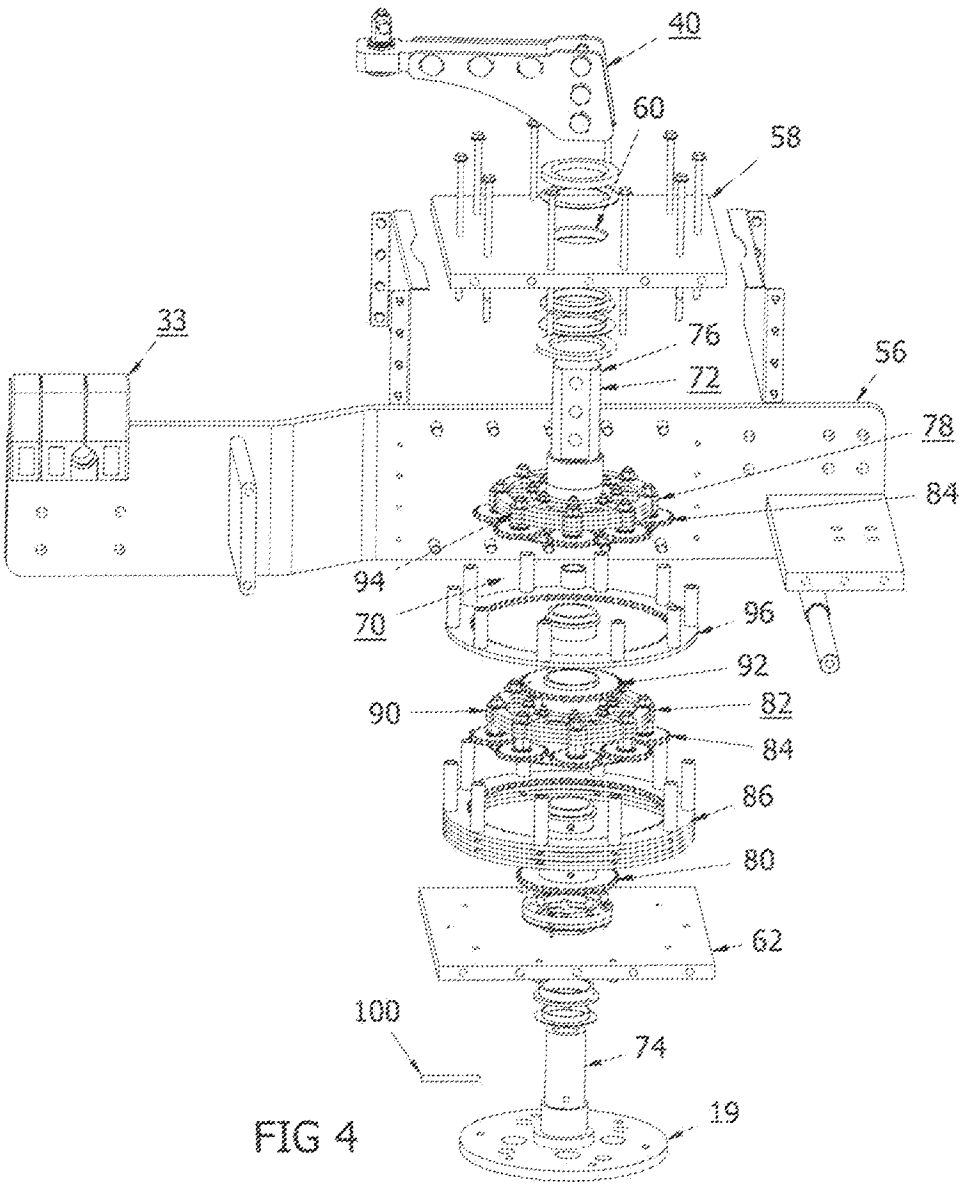
FIG. 4 is an exploded view of FIG. 3.

The horizontal vertical break switch 10 of prior art as described thus far is conventional and well known in the industry. As shown in FIG. 2, the live base assembly 52 of the present invention includes a first side plate 54 and an oppositely disposed parallel second side plate 56, that have been modified from the side plates of the prior art live base assembly which are straight and not bent. This modified form of the side plates of the prior art live base assembly results in the live base assembly 52 of the present invention having a wide section 52*a* and a narrow section 52*b*, as shown in FIG. 2, instead of the side plates having a uniform width of separation like the prior art live base assembly, not shown in the drawings. The modified live base assembly 52 also includes a top plate 58 and a bottom plate 62 which are positioned between the first and second side plates 54, 56 in the wide section 52*a* as shown in FIG. 2. As shown in FIG. 3, the bottom plate 62 is provided with a bottom plate crank shaft aperture 64. The top plate 58 is provided with a top plate crank shaft aperture 60. The narrow section 52*b* of live base assembly 52 is configured to carry a switch blade proximal end contact assembly 33 proximate the hinge assembly 28, for provided electrical connection to the proximal end 30 of the switch blade 26 as shown in FIG. 1. Also, as shown in FIG. 3, the improvement of the present invention provides a planetary gear reduction assembly 65 housed within the wide section 52*a* of the modified live base assembly 52. The planetary gear reduction assembly 65 includes a planetary gear reduction switch drive mechanism having at least one stage. A stage may include a stationary ring gear and a rotatable carrier assembly with planet gears. As shown in FIGS. 3 and 4, an embodiment for a high voltage vertical break disconnect switch of the extra high voltage (EHV) type, having a two-stage planetary gear reduction switch drive mechanism 70 in place of the prior art one piece crank shaft 50 is provided. This embodiment of the invention can be seen in FIG. 3 showing the components of the two-stage planetary gear reduction switch drive mechanism 70 with an associated two-piece crank shaft assembly 72, which are mounted between a plate 19 of rotatable third post insulator 14 and the crank assembly 40. The two-piece crank shaft assembly 72 is coaxially aligned with and in operational rotational relationship with the rotatable perpendicular cylindrically-shaped insulator 13*a*. The linkage beyond the crank assembly 40, that moves the switch blade 26 between the open and closed positions is the same as the prior art arrangement already described. As can be seen in FIGS. 3 and 4, the two-stage planetary gear reduction switch drive mechanism 70 circumferentially surrounds a substantial portion of the two-piece crank shaft assembly 72. The two-piece crank shaft assembly 72 includes a lower shaft part 74 which is solidly connected to plate 19 of the rotatable third post perpendicular cylindrically-shaped insulator 14. The lower crankshaft part 74 has a central recess 75, as can be seen in FIG. 3, for receiving a lower crankshaft part engagement portion 77 of the upper crankshaft part 76. An upper crankshaft part support bearing 79 is operatively arranged proximate the central recess 75, as shown in FIG. 3, for rotatably supporting the lower crankshaft part engagement portion 77. The lower crankshaft part engagement portion 77 is rotatable within the central recess 75. An upper shaft part 76 of the two-piece crank shaft assembly 72 is turned by means of a second planetary gear set 78 of the two-stage planetary gear reduction switch drive mechanism 70. The lower shaft part 74 of the two-piece crank shaft assembly 72 has a first stage sun gear 80 connected to it as the input gear which engages with a first stage planetary gear set 82 as shown in FIG. 4. The first stage planetary gear set 82 and the second stage planetary gear set 78, each include eight planet gears 84, for example. The first stage planetary gear set 82 is turned by the interaction or engagement with the first sun gear 80, i.e., the input gear, and a stationary first stage ring gear 86. The stationary first stage ring gear 86 is held fixed relative to plates 58 and 62 by bolting. Plates 58 and 62 are held from turning by stationary insulator oppositely disposed side plates 56 and 54 of the live base assembly 52, as can be discerned from FIGS. 2 and 3. The first stage planetary gear set 82 is nested within the stationary first stage ring gear 86 as can be seen by reference to FIGS. 3 and 4. Within the center of the first stage planetary gear set 82 is a first stage planet carrier 90 configured to carry the first stage planetary gear set 82 shown on FIG. 4.

In this embodiment, a second stage sun gear 92 is rigidly connected to the first stage planet carrier 90 and is driven by the first stage planetary gear set 82. The second stage sun gear 92 is the input gear for the second stage planetary gear set 78. The second stage planetary gear set 78 is turned by the interaction or engagement of the second stage sun gear 92, i.e., the input gear, and a stationary second stage ring gear 96 which is held stationary in the same manner as the first stage ring gear 86. Within the center of the second stage planetary gear set 78 is a second stage planet carrier 94 configured to carry the second stage planetary gear set 78. The upper shaft part 76 of the two-piece crank shaft assembly 72 is solidly connected to the second stage planet carrier 94 and is the output of the two-stage planetary gear reduction switch drive mechanism 70. The upper shaft part 76 is part of the second stage planetary gear set 78 and is the gear reduction output.

The lower shaft part 74 of the two-piece crank shaft assembly 72 is operably connected to the first stage sun gear 80 by cross pin 100. As the lower shaft part 74 of the two-piece crank shaft assembly 72 is caused to rotate by perpendicular cylindrically-shaped insulator 14 connected to the prime mover 36 the first stage sun gear 80 actuates first stage planetary gear set 82 of the two-stage planetary gear reduction switch drive mechanism 70.

This embodiment of the two-stage planetary gear reduction switch drive mechanism 70 with an associated two-piece crank shaft assembly 72 provides for the rotatable third post insulator 14 and the lower shaft part 74 of the two-piece crank shaft assembly 72 to rotate multiple times while the upper shaft part 76 of the two-piece crank shaft assembly 72 rotates about 180 degrees. This particular arrangement has a 9:1 gear reduction. The rotatable third post insulator 14 rotates about 4.5 times to rotate the crank assembly 40 through 0.5 rotations, thus providing reduced stress on the rotating perpendicular cylindrically-shaped insulator 14 and power transmitting components between prime mover 36 and the switch crank component compared to prior art switches, particularly under heavy thick ice conditions when opening or closing.

Figure 5:
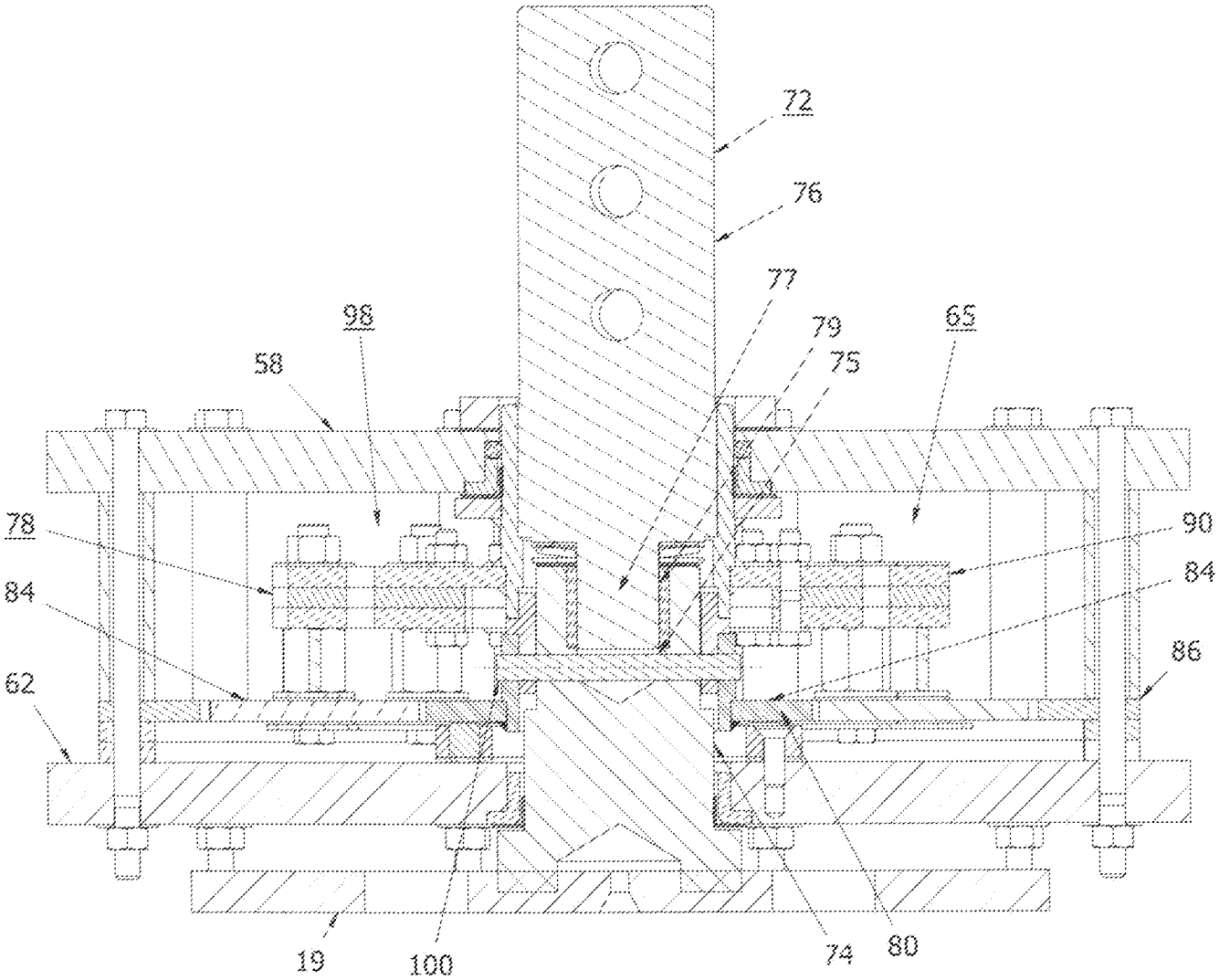
FIG. 5 is a schematic sectional elevation view of a single-stage planetary gear reduction assembly version of the invention; and, FIG. 6 is an exploded view of FIG. 5.
Figure 6:
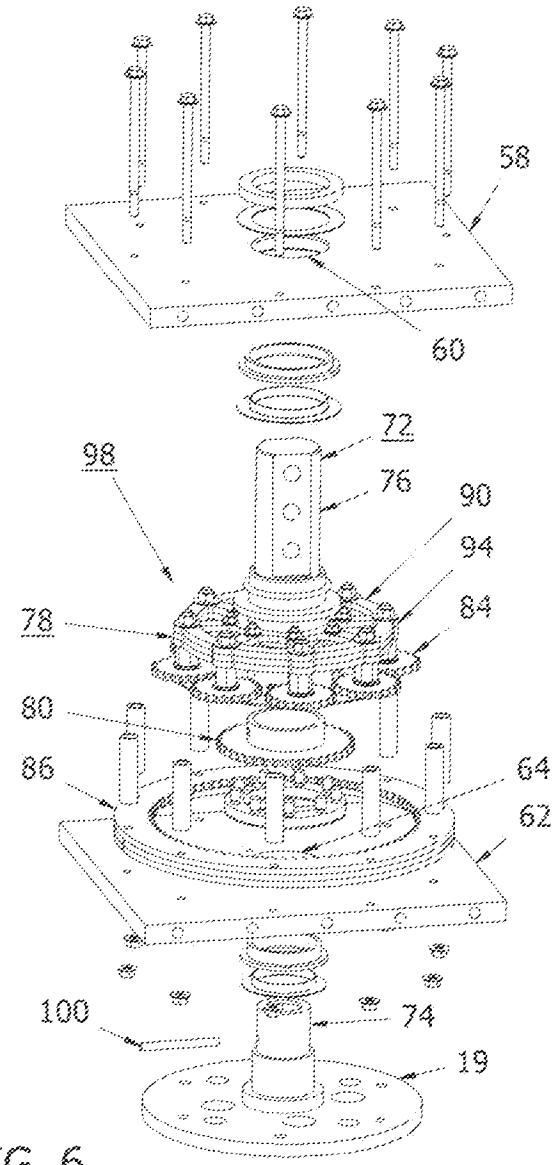

In a second embodiment of the invention, applicable to the case of a high voltage vertical break disconnect switch 10 rated for voltages of 345 kV and lower, a single-stage planetary gear reduction switch drive mechanism 98 of the present invention may be utilized as shown in FIGS. 5 and 6, instead of a two-stage mechanism. Like reference numerals are used for the present embodiment as were used for the first embodiment and represent the same or similar elements for this embodiment. This embodiment of the invention as can be seen in FIG. 6 shows the components of the single-stage planetary gear reduction switch drive mechanism 98 with an associated two-piece crank shaft assembly 72. As can be seen in FIGS. 5 and 6, the single-stage planetary gear reduction switch drive mechanism 98 circumferentially surrounds a substantial portion of the two-piece crank shaft assembly 72. The two-piece crank shaft assembly 72 includes a lower shaft part 74 which is solidly connected to the plate 19 of the rotatable third post perpendicular cylindrically-shaped insulator 14. The lower crankshaft part 74 has a central recess 75, as can be seen in FIG. 5, for receiving a lower crankshaft part engagement portion 77 of the upper crankshaft part 76. An upper crankshaft part support bearing 79 is operatively arranged proximate the central recess 75, as shown in FIG. 5, for rotatably supporting the lower crankshaft part engagement portion 77. The lower crankshaft part engagement portion 77 is rotatable within the central recess 75. An upper shaft part 76 of the two-piece crank shaft assembly 72 is connected to the single-stage planetary gear set 78 of the single-stage planetary gear reduction switch drive mechanism 98. As shown in FIG. 6, the lower shaft part 74 of the two-piece crank shaft assembly 72 has a single stage sun gear 80 connected to it by cross pin 100 and is the input gear which engages with the single-stage planetary gear set 78. The single-stage planetary gear set 78 includes eight planet gears 84, for example. The single-stage planetary gear set 78 is turned by the interaction or engagement with the single-stage sun gear 80, i.e., the input gear, and a stationary single stage ring gear 86. The stationary single stage ring gear 86 is held fixed relative to plates 58 and 62 by bolting. Plates 58 and 62 are held from turning by stationary insulator oppositely disposed side plates 56 and 54 of the live base assembly 52, as can be discerned from FIGS. 2 and 5. The single-stage planetary gear set 78 is nested within the stationary single stage ring gear 86 as can be seen by reference to FIGS. 5 and 6.

Within the center of the single stage planetary gear set 78 is a single stage planet carrier 90 configured to carry the single stage planetary gear set 78. The upper shaft part 76 of the two-piece crank shaft assembly 72 is solidly connected to the single stage planet carrier 90 and is the output of the single-stage planetary gear reduction switch drive mechanism 98. The upper shaft part 76 is part of the single stage planetary gear set 78 and is the gear reduction output.

As the lower shaft part 74 of the two-piece crank shaft assembly 72 is caused to rotate by insulator 14 connected to the prime mover 36, the single stage sun gear 80 actuates the single stage planetary gear set 78 of the single-stage planetary gear reduction switch drive mechanism 98.

This embodiment of the single-stage planetary gear reduction switch drive mechanism 98 with an associated two-piece crank shaft assembly 72 provides for the rotatable third post insulator 14 and the lower shaft part 74 of the two piece crank shaft assembly 72 to rotate multiple times while the upper shaft part 76 of the two piece crank shaft assembly 72 rotates about 180 degrees. This particular arrangement has a 3:1 gear reduction. The rotatable third post insulator 14 rotates about 1.5 times to rotate the crank assembly 40 through 0.5 rotations, thus providing reduced stress on the rotating insulator 14 and power transmitting components between prime mover 36 and the switch crank component compared to prior art switches, particularly under heavy thick ice conditions when opening or closing.

LIST OF REFERENCE NUMERALS

10 high voltage air break disconnect switch
12 longitudinal beam
12*a* top of 12
13*a* stationary $1^{st}$ post perpendicular cylindrically-shaped insulator
13*b* stationary $2^{nd}$ post perpendicular cylindrically-shaped insulator
14 rotatable $3^{rd}$ post perpendicular cylindrically-shaped insulator
15 top of 13*a*
16 motor drive shaft
18 bottom of 14
19 plate of 14
20 line-terminal connection
22 U-shaped stationary break-jaw contact assembly
23 longitudinal axis of 14
24 elongated movable switch-blade assembly

25 drive shaft support bearing assembly
26 elongated switch blade
27 longitudinal axis of 24
28 hinge assembly
30 proximal end of 26
32 distal end of 26
33 switch blade proximal end contact assembly
34 switch blade tip
36 prime mover, motor or geared hand crank assembly
38 hinge shaft
40 crank assembly
40*a* one end of 40
40*b* other end of 40
42 movable link assembly
44 hinge axis
46 pin
48 spring counter balance tube assembly
50 one piece crank shaft of prior art
52 live base assembly
52*a* wide section of 52
52*b* narrow section of 52
54 first live base assembly side plate
56 second live base assembly side plate
58 top plate of live base assembly
60 top plate crank shaft aperture
62 bottom plate of live base assembly
64 bottom plate crank shaft aperture
65 planetary gear reduction assembly
66 one end of 48
67 fixed pin
68 the other end of 48
69 counterbalance arm assembly
70 two-stage planetary gear reduction switch drive mechanism
72 two piece crank shaft assembly
74 lower shaft part of 72
75 central recess
76 upper shaft part of 72
77 lower crankshaft part engagement portion
78 $2^{nd}$ stage or single stage planetary gear set
79 upper crankshaft part engagement portion
80 first stage or single stage sun gear
82 first stage planetary gear set
84 planet gears
86 stationary first stage or single stage ring gear
90 first stage planet carrier or single stage planet carrier
92 second stage sun gear
94 second stage planet carrier
96 stationary second stage ring gear
98 single-stage planetary gear reduction switch drive mechanism
100 cross pin Of course variations from the foregoing embodiments are possible without departing from the scope of the invention.

What is claimed is:

1. A high voltage vertical break disconnect switch comprising:

three perpendicular cylindrically-shaped insulators mounted in operative arrangement on a longitudinal beam, one of the perpendicular cylindrically-shaped insulators being rotatable axially and the other of the perpendicular cylindrically-shaped insulators being stationary, a prime mover including a drive shaft in operative rotational drive arrangement with the one rotatable perpendicular cylindrically-shaped insulator, an elongated movable switch-blade assembly in operative arrangement with the prime mover drive shaft, the elongated movable switch-blade assembly including an elongated switch blade for electrically opening and closing the high voltage vertical break disconnect switch, the elongated movable switch-blade assembly including a hinge assembly configured to movably support a proximal end of the elongated switch blade, the hinge assembly in electrically conductive relationship with the elongated switch blade, a movable link assembly in operative arrangement with the hinge assembly for rotating the elongated switch blade from a closed electrically conductive position to an open electrically non-conductive position, a planetary gear reduction drive assembly including a planetary gear reduction switch drive mechanism having at least one stage, the planetary gear reduction switch drive mechanism including at least a two-piece crank shaft assembly mounted coaxially and in operative rotational relationship with the rotatable perpendicular cylindrically-shaped insulator, the planetary gear reduction switch drive mechanism in operative rotational drive arrangement with the movable link assembly, the planetary gear reduction switch drive assembly operatively supported by and housed within a live base assembly having oppositely disposed side plates a first of the stationary perpendicular cylindrically-shaped insulators in operative supportive relationship with the base assembly, the movable link assembly mounted in operative arrangement between the two-piece crank shaft assembly and the hinge assembly, whereby loads to be transmitted between the prime mover drive shaft and the movable link assembly are reduced by the planetary gear reduction drive assembly.

2. The high voltage vertical break disconnect switch of claim 1, wherein the two-piece crank shaft comprises a lower crankshaft part and an upper crankshaft part, the upper crankshaft part coaxially aligned with the lower crankshaft part and in operative arrangement therewith.

3. The high voltage vertical break disconnect switch of claim 2, wherein the planetary gear reduction switch drive assembly is a two-stage planetary gear reduction switch drive mechanism.

4. The high voltage vertical break disconnect switch of claim 2, wherein the planetary gear reduction switch drive assembly is a single-stage planetary gear reduction switch drive mechanism.

5. The high voltage disconnect switch of claim 1, wherein the prime mover comprises a motor or a geared hand crank assembly.

6. The high voltage vertical break disconnect switch of claim 2, wherein the lower crankshaft part is in direct drive solid connection with the top of the rotatable perpendicular cylindrically-shaped insulator.

7. The high voltage vertical break disconnect switch of claim 3, wherein the two-stage planetary gear reduction switch drive mechanism includes a second stage planetary gear set in operative rotational drive arrangement with the upper crankshaft part with respect to the rotation of the lower crankshaft part.

8. The high voltage vertical break disconnect switch of claim 7, wherein the two-stage planetary gear reduction switch drive mechanism further includes a first stage sun gear in operative connection with a top of the lower crankshaft part, the first stage sun gear configured as an input gear to a first stage planetary gear set.

9. The high voltage vertical break disconnect switch of claim 8, wherein the two-stage planetary gear reduction switch drive mechanism further includes a stationary first stage ring gear in operative connection with the live base assembly oppositely disposed side plates, a first stage planet carrier assembly configured to rotate by the interaction of the first stage sun gear, the first stage planetary gear set and the stationary first stage ring gear.

10. The high voltage vertical break disconnect switch of claim 9, wherein the two-stage planetary gear reduction switch drive mechanism further includes a second stage sun gear configured in rigid connection with the first stage planet carrier, the second stage sun gear configured as an input gear to a second stage planetary gear set of the two-stage planetary gear reduction switch drive mechanism.

11. The high voltage vertical break disconnect switch of claim 10, wherein the two-stage planetary gear reduction switch drive mechanism further includes a stationary second stage ring gear in operative connection with the live base assembly oppositely disposed side plates, a second stage planet carrier assembly is configured to rotate by the interaction of the second stage sun gear, the second stage planetary gear set and the stationary second stage ring gear.

12. The high voltage vertical break disconnect switch of claim 11, further comprising a second stage planet carrier assembly configured in solid connection with the upper crankshaft part as an output of the two-stage planetary gear reduction switch drive mechanism and in operative rotational drive arrangement with the movable link assembly.

13. The high voltage vertical break disconnect switch of claim 12, wherein the first stage planetary gear set and the second stage planetary gear set each comprise a plurality of planet gears.

14. The high voltage vertical break disconnect switch of claim 2, wherein the lower crankshaft part has a central recess proximate a top of the lower crankshaft part for operatively receiving and rotatably supporting a bottom portion of the upper crankshaft part.

15. The high voltage vertical break disconnect switch of claim 14, wherein the upper crankshaft part has a lower crankshaft engagement portion configured to operatively engage the central recess of the lower crankshaft part.

16. The high voltage vertical break disconnect switch of claim 15, further comprising an upper crankshaft part support bearing configured in operative arrangement in the central recess of the lower crankshaft part.

17. The high voltage vertical break disconnect switch of claim 4, wherein the single-stage planetary reduction switch drive mechanism includes a single-stage planetary gear set comprising a plurality of planet gears in operative rotational drive arrangement the upper crankshaft part with respect to the lower crankshaft part.

18. The high voltage vertical break disconnect switch of claim 17, wherein the single-stage planetary gear reduction switch drive mechanism further includes a single stage sun gear in operative connection with a top of the lower crankshaft part, the single stage sun gear configured as an input gear to the single-stage planetary gear set.

19. The high voltage vertical break disconnect switch of claim 18, wherein the single-stage planetary gear reduction switch drive mechanism further includes a stationary single stage ring gear in operative connection with the base assembly oppositely disposed side plates, a single stage planet carrier assembly configured to rotate by the interaction of the single stage sun gear, the single stage planetary gear set and the stationary single stage ring gear.

20. The high voltage vertical break disconnect switch of claim 19, wherein the single stage planet carrier assembly configured in solid connection with the upper crankshaft part as an output of the single-stage planetary gear reduction switch drive mechanism and in operative rotational drive arrangement with the movable link assembly.

* * * * *